US008498669B2

(12) United States Patent
Naguib et al.

(10) Patent No.: US 8,498,669 B2
(45) Date of Patent: Jul. 30, 2013

(54) ANTENNA ARRAY CALIBRATION FOR WIRELESS COMMUNICATION SYSTEMS

(75) Inventors: Ayman Fawzy Naguib, Cupertino, CA (US); Avneesh Agrawal, San Diego, CA (US); Alexei Gorokhov, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 1491 days.

(21) Appl. No.: 11/398,077

(22) Filed: Apr. 4, 2006

(65) Prior Publication Data

US 2006/0284725 A1 Dec. 21, 2006

Related U.S. Application Data

(60) Provisional application No. 60/691,458, filed on Jun. 16, 2005, provisional application No. 60/733,020, filed on Nov. 2, 2005.

(51) Int. Cl.
*G08B 5/22* (2006.01)

(52) U.S. Cl.
USPC ..... 455/562.1; 455/506; 455/550.1; 455/445; 455/423; 455/522

(58) Field of Classification Search
USPC ..... 455/562, 562.1, 509, 550.1, 445, 455/522, 423; 340/7.39; 343/729; 702/107
See application file for complete search history.

(56) References Cited

U.S. PATENT DOCUMENTS

| | | | |
|---|---|---|---|
| 5,008,900 | A | 4/1991 | Critchlow et al. |
| 6,037,898 | A | 3/2000 | Parish et al. |
| 6,188,896 | B1 | 2/2001 | Perahia et al. |
| 6,448,939 | B2 | 9/2002 | Maruta et al. |
| 6,462,704 | B2 | 10/2002 | Rexberg et al. |
| 6,496,140 | B1 | 12/2002 | Alastalo |
| 6,600,445 | B2 | 7/2003 | Li |
| 6,615,024 | B1 | 9/2003 | Boross et al. |
| 6,661,284 | B1 | 12/2003 | Luz et al. |
| 6,690,952 | B2 | 2/2004 | Nishimori et al. |
| 6,701,264 | B2 | 3/2004 | Caso et al. |
| 6,778,147 | B2 | 8/2004 | Sanada et al. |
| 6,801,867 | B2 | 10/2004 | Bortnyk et al. |
| 6,876,870 | B2 | 4/2005 | Hiramatsu et al. |

(Continued)

FOREIGN PATENT DOCUMENTS

| | | | |
|---|---|---|---|
| CN | 1507168 | A | 6/2004 |
| EP | 0642191 | A1 | 3/1995 |

(Continued)

OTHER PUBLICATIONS

International Search Report—PCT/US06/015726, International Search Authority—European Patent Office, Aug. 11, 2006.

(Continued)

*Primary Examiner* — Kiet Doan
*Assistant Examiner* — Michael T Vu
(74) *Attorney, Agent, or Firm* — Howard Seo

(57) ABSTRACT

Calibration for a transmit chain of a device transmitting information to multiple devices over wireless links and receive chains of the multiple devices receiving information over one of the wireless links utilizing a plurality of forward link channel estimates received from at least some of the plurality of devices and a plurality of reverse link channel estimates from the plurality of devices.

27 Claims, 10 Drawing Sheets

U.S. PATENT DOCUMENTS

| | | | | |
|---|---|---|---|---|
| 6,888,809 | B1 | 5/2005 | Foschini et al. | |
| 6,904,290 | B1 | 6/2005 | Palenius et al. | |
| 6,947,768 | B2 | 9/2005 | Adachi et al. | |
| 7,031,669 | B2 | 4/2006 | Vaidyanathan et al. | |
| 7,035,592 | B1 | 4/2006 | Doi et al. | |
| 7,079,514 | B2 | 7/2006 | Kim et al. | |
| 7,133,698 | B2 | 11/2006 | Miyoshi et al. | |
| 7,184,734 | B2 | 2/2007 | Yuda et al. | |
| 7,205,936 | B2 | 4/2007 | Park et al. | |
| 7,280,072 | B2 | 10/2007 | Mallick | |
| 7,304,605 | B2 | 12/2007 | Wells | |
| 7,313,174 | B2 | 12/2007 | Alard et al. | |
| 7,392,016 | B2 | 6/2008 | Tsien et al. | |
| 7,403,798 | B2 | 7/2008 | Doi | |
| 2001/0005685 | A1 | 6/2001 | Nishimori et al. | |
| 2001/0011861 | A1 | 8/2001 | Rexberg et al. | |
| 2001/0020919 | A1* | 9/2001 | Maruta | 343/729 |
| 2002/0103013 | A1 | 8/2002 | Watson et al. | |
| 2003/0040880 | A1* | 2/2003 | Bortnyk | 702/107 |
| 2003/0058166 | A1 | 3/2003 | Hirabe | |
| 2003/0064752 | A1 | 4/2003 | Adachi et al. | |
| 2003/0064762 | A1 | 4/2003 | Tanabe et al. | |
| 2003/0227408 | A1 | 12/2003 | Sanada et al. | |
| 2004/0048580 | A1 | 3/2004 | Lunn et al. | |
| 2004/0048584 | A1 | 3/2004 | Vaidyanathan et al. | |
| 2004/0105386 | A1 | 6/2004 | Sipola | |
| 2004/0142729 | A1* | 7/2004 | Yuda et al. | 455/562.1 |
| 2004/0166808 | A1 | 8/2004 | Hasegawa et al. | |
| 2004/0217920 | A1 | 11/2004 | Ishikawa | |
| 2004/0266483 | A1 | 12/2004 | Choi | |
| 2005/0130663 | A1* | 6/2005 | Hong et al. | 455/445 |
| 2005/0162305 | A1 | 7/2005 | Wells et al. | |
| 2005/0164664 | A1 | 7/2005 | DiFonzo et al. | |
| 2006/0019712 | A1 | 1/2006 | Choi et al. | |
| 2006/0232470 | A1 | 10/2006 | Mallick et al. | |
| 2006/0240784 | A1 | 10/2006 | Naguib et al. | |
| 2006/0286974 | A1 | 12/2006 | Gore et al. | |
| 2006/0293087 | A1 | 12/2006 | Tsutsui et al. | |
| 2007/0099570 | A1 | 5/2007 | Gao et al. | |
| 2007/0099573 | A1 | 5/2007 | Naguib et al. | |
| 2007/0099670 | A1 | 5/2007 | Naguib et al. | |
| 2007/0224942 | A1 | 9/2007 | Kuramoto et al. | |
| 2007/0225042 | A1 | 9/2007 | Kitahara et al. | |
| 2008/0004078 | A1 | 1/2008 | Barratt et al. | |

FOREIGN PATENT DOCUMENTS

| | | | |
|---|---|---|---|
| EP | 0654915 | A2 | 5/1995 |
| EP | 1104122 | | 5/2001 |
| GB | 2346013 | | 7/2000 |
| JP | 01213038 | | 8/1989 |
| JP | 2000216618 | | 4/2000 |
| JP | 2001177458 | A | 6/2001 |
| JP | 2002141730 | A | 5/2002 |
| JP | 2002530998 | | 9/2002 |
| JP | 3332911 | | 10/2002 |
| JP | 2003092508 | | 3/2003 |
| JP | 2003264492 | | 9/2003 |
| JP | 2003309513 | | 10/2003 |
| JP | 2004-304586 | | 10/2004 |
| JP | 2004-343468 | | 12/2004 |
| JP | 2006512807 | | 4/2006 |
| KR | 20010076252 | | 8/2001 |
| KR | 20010110464 | | 12/2001 |
| KR | 1020020022109 | | 3/2002 |
| KR | 20020026605 | | 4/2002 |
| KR | 200289094 | | 11/2002 |
| KR | 100584625 | | 5/2006 |
| WO | 9914870 | | 3/1999 |
| WO | 9957820 | A1 | 11/1999 |
| WO | WO0031892 | A1 | 6/2000 |
| WO | 0119101 | | 3/2001 |
| WO | WO0211237 | A1 | 2/2002 |
| WO | 02078209 | | 10/2002 |
| WO | 2004039022 | | 5/2004 |
| WO | WO2004038952 | | 5/2004 |
| WO | WO2004039011 | | 5/2004 |
| WO | WO2005081483 | | 9/2005 |
| WO | WO2006116453 | A1 | 11/2006 |

OTHER PUBLICATIONS

Written Opinion —PCT/US06/015726, International Search Authority —European Patent Office, Aug. 11, 2006.

International Preliminary Report on Patentability —PCT/US06/015726, The International Bureau of WIPO—Geneva, Switzerland, Oct. 24, 2007.

* cited by examiner

ANTENNA ARRAY CALIBRATION FOR WIRELESS COMMUNICATION SYSTEMS

CLAIM OF PRIORITY UNDER 35 U.S.C. §119

This application claims benefit under 35 U.S.C. § 119(e) from U.S. Provisional Patent Application Ser. No. 60/691,458 entitled "A METHOD FOR OVER THE AIR CALIBRATION OF TDD MULTI ANTENNA SYSTEMS", filed Jun. 16, 2005, and U.S. Provisional Patent application Ser. No. 60/733,020 entitled "ANTENNA ARRAY CALIBRATION FOR WIRELESS COMMUNICATION SYSTEMS", filed Nov. 2, 2005, both of which are hereby incorporated by reference in their entirety.

BACKGROUND

I. Field

The following description relates generally to wireless communications, and, amongst other things, to over-the-air calibrating an antenna array.

II. Background

Wireless networking systems have become a prevalent means by which a majority of people worldwide has come to communicate. Wireless communication devices have become smaller and more powerful in order to meet consumer needs and to improve portability and convenience. The increase in processing power in mobile devices such as cellular telephones has lead to an increase in demands on wireless network transmission systems. Such systems typically are not as easily updated as the cellular devices that communicate there over. As mobile device capabilities expand, it can be difficult to maintain an older wireless network system in a manner that facilitates fully exploiting new and improved wireless device capabilities.

More particularly, frequency division based techniques typically separate the spectrum into distinct channels by splitting it into uniform chunks of bandwidth, for example, division of the frequency band allocated for wireless cellular telephone communication can be split into channels, each of which can carry a voice conversation or, with digital service, carry digital data. Each channel can be assigned to only one user at a time. One commonly utilized variant is an orthogonal frequency division technique that effectively partitions the overall system bandwidth into multiple orthogonal subcarriers. These subcarriers are also referred to as tones, carriers, bins, and/or frequency channels. With time division based techniques, a band is split time-wise into sequential time slices or time slots. Each user of a channel may be provided with a time slice for transmitting and receiving information in a round-robin manner. For example, at any given time t, a user is provided access to the channel for a short burst. Then, access switches to another user who is provided with a short burst of time for transmitting and receiving information. The cycle of "taking turns" continues, and eventually each user is provided with multiple transmission and reception bursts.

Code division based techniques typically transmit data over a number of frequencies available at any time in a range. In general, data is digitized and spread over available bandwidth, wherein multiple users can be overlaid on the channel and respective users can be assigned a unique sequence code. Users can transmit in the same wide-band chunk of spectrum, wherein each user's signal is spread over the entire bandwidth by its respective unique spreading code. This technique can provide for sharing, wherein one or more users can concurrently transmit and receive. Such sharing can be achieved through spread spectrum digital modulation, wherein a user's stream of bits is encoded and spread across a very wide channel in a pseudo-random fashion. The receiver is designed to recognize the associated unique sequence code and undo the randomization in order to collect the bits for a particular user in a coherent manner.

A typical wireless communication network (e.g., employing frequency, time, and code division techniques) includes one or more base stations that provide a coverage area and one or more mobile (e.g., wireless) terminals that can transmit and receive data within the coverage area. A typical base station can simultaneously transmit multiple data streams for broadcast, multicast, and/or unicast services, wherein a data stream is a stream of data that can be of independent reception interest to a mobile terminal. A mobile terminal within the coverage area of that base station can be interested in receiving one, more than one or all the data streams carried by the composite stream. Likewise, a mobile terminal can transmit data to the base station or another mobile terminal. Such communication between base station and mobile terminal or between mobile terminals can be degraded due to channel variations and/or interference power variations. For example, the aforementioned variations can affect base station scheduling, power control and/or rate prediction for one or more mobile terminals.

When antenna arrays and/or base stations are employed in conjunction with a time domain duplexed (TDD) channel transmission technique, very large gains can be realized. A key assumption in realizing these gains is that due to the TDD nature of the transmission and reception, both the forward link (FL) and reverse link (RL) observe similar physical propagation channels corresponding to a common carrier frequency. However, in practice the overall transmit and receive chains, which can include the analog front ends and the digital sampling transmitters and receivers, as well as the physical cabling and antenna architecture, contribute to the over all channel response experienced by the receiver. In other words, the receiver will see an overall or equivalent channel between the input of the transmitter digital to analog converter (DAC) and the output of the receiver analog to digital converter (ADC), which can comprise the analog chain of the transmitter, the physical propagation channel, the physical antenna array structure (including cabling), and the analog receiver chain.

In view of at least the above, there exists a need in the art for a system and/or methodology of calibrating in antenna arrays employed in wireless communication devices.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

According to an aspect, a method of calibrating an antenna array in a wireless network comprises receiving estimates for first communication links, for communication to at least two terminals, from the terminals and determining estimates of second communication links, from the at least two terminals. Then, a calibration ratio based upon estimates of the first and second communication links is determined.

According to another aspect, a wireless communication apparatus comprises at least two antennas and a processor coupled with the at least two antennas. The processor is configured to determine a calibration ratio, based upon a plurality of forward link channel estimates and reverse link channel estimates from a plurality of access terminals.

According to yet another aspect, an apparatus can comprise means for receiving first channel estimate information corresponding to transmissions to at least two access terminals, means for determining second channel estimate information corresponding to transmissions from at least two access terminals, and means for determining a calibration ratio based upon the first and second channel estimate information.

Yet another aspect relates to a processor-readable medium having stored thereon instructions for use by a processor. The instructions comprise instructions to determine a plurality of reverse link channel estimates for a plurality of access terminals and determine a calibration ratio, based upon a plurality of forward link channel estimates received from at least some of the plurality of access terminals and the plurality of reverse link channel estimates from the plurality of access terminals.

In additional aspects a method is provided that determines a transmission interval for a last calibration for a particular AGC state. Then a determination is made, based upon the transmission interval since the last calibration, as to whether to perform another calibration for the AGC state or to read a prior calibration vector or weights from a memory for the AGC state to calibrate the current transmission for the AGC state.

In a further aspect, a wireless communication device includes a processor is configured to determine, based upon the transmission interval since the last calibration, whether to perform another calibration for the AGC state or to read a prior calibration vector or weights from a memory for the AGC state to calibrate the current transmission for the AGC state. The processor is coupled to a memory.

In yet another aspect, a wireless communication device includes a means for determining, based upon the transmission interval since the last calibration, whether to perform another calibration for the AGC state or to read a prior calibration vector or weights from a memory for the AGC state to calibrate the current transmission for the AGC state. The wireless communication device may also include means for reading weights, or a calibration vector, from a memory for calibrating a current transmission if the transmission interval is less than some criteria and means for performing another calibration operation, to be used for the current transmission, if the transmission interval exceeds the criteria.

To the accomplishment of the foregoing and related ends, the one or more embodiments comprise the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

Figure 1:
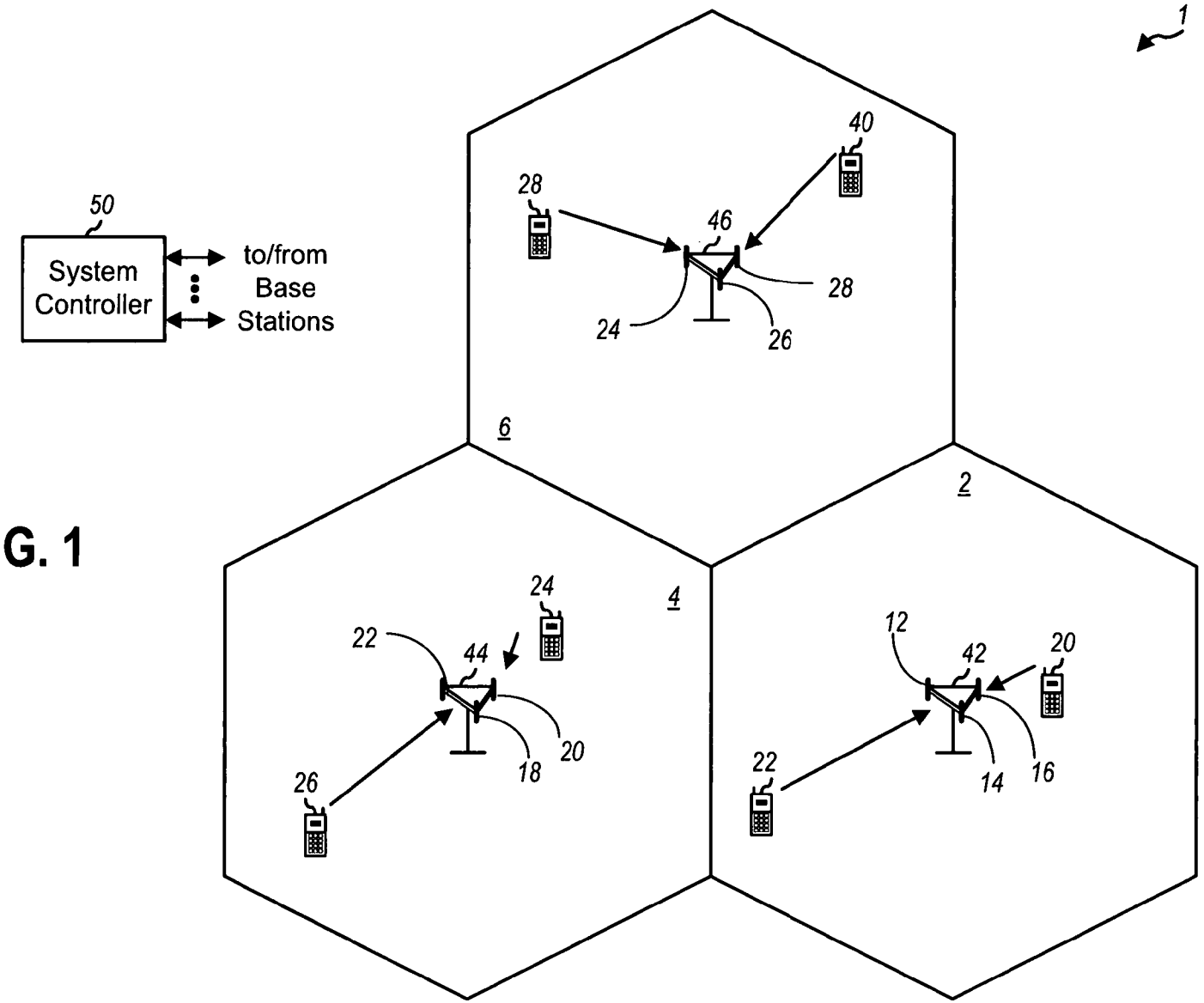
FIG. 1 illustrates aspects of a multiple access wireless communication system

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

As used in this application, the terms "component," "system," and the like are intended to refer to a computer-related entity, either hardware, a combination of hardware and software, software, or software in execution. For example, a component may be, but is not limited to being, a process running on a processor, a processor, an object, an executable, a thread of execution, a program, and/or a computer. One or more components may reside within a process and/or thread of execution and a component may be localized on one computer and/or distributed between two or more computers. Also, these components can execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

Furthermore, various embodiments are described herein in connection with a subscriber station. A subscriber station can also be called a system, a subscriber unit, mobile station, mobile, remote station, access point, base station, remote terminal, access terminal, user terminal, user agent, user equipment, etc. A subscriber station may be a cellular telephone, a cordless telephone, a Session Initiation Protocol (SIP) phone, a wireless local loop (WLL) station, a personal digital assistant (PDA), a handheld device having wireless connection capability, or other processing device connected to a wireless modem.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer readable media can include, but are not limited to, magnetic storage devices (e.g., hard disk, floppy disk, magnetic strips . . . ), optical disks (e.g., compact disk (CD), digital versatile disk (DVD) . . . ), smart cards, flash memory devices (e.g., card, stick, key drive . . . ), and integrated circuits such as read only memories, programmable read only memories, and electrically erasable programmable read only memories.

Referring to FIG. 1, a multiple access wireless communication system according to one embodiment is illustrated. A multiple access wireless communication system 1 includes multiple cells, e.g. cells 2, 104, and 106. In FIG. 1, each cell 2, 4, and 6 may include an access point that includes multiple sectors. The multiple sectors are formed by groups of antennas each responsible for communication with access terminals in a portion of the cell. In cell 2, antenna groups 12, 14, and 16 each correspond to a different sector. In cell 4, antenna groups 18, 20, and 22 each correspond to a different sector. In cell 6, antenna groups 24, 26, and 28 each correspond to a different sector.

Each cell includes several access terminals which are in communication with one or more sectors of each access point. For example, access terminals 30 and 32 are in communication with access point base 42, access terminals 34 and 36 are in communication with access point 44, and access terminals 38 and 40 are in communication with access point 46.

Controller 50 is coupled to each of the cells 2, 4, and 6. Controller 50 may contain one or more connections to multiple networks, e.g. the Internet, other packet based networks, or circuit switched voice networks that provide information to, and from, the access terminals in communication with the cells of the multiple access wireless communication system 1. The controller 50 includes, or is coupled with, a scheduler that schedules transmission from and to access terminals. In other embodiments, the scheduler may reside in each individual cell, each sector of a cell, or a combination thereof.

In order to facilitate calibration of transmissions to the access terminals, it is helpful to calibrate the access point gain calibration loop to deal with mismatches due to the transmit and receive chains of the access point. However, due to the noise in the channel, any calibration estimates based on the signals received at the access terminals, forward link, and transmitted from the access terminals, reverse link, may contain noise and other channel variations that may call into question the estimates provided used to provide the calibration. In order to overcome the channel noise effects, multiple calibrations on both the forward link and reverse link are utilized for multiple access terminals. In certain aspects, multiple transmissions to and from each access terminal are taken into account to perform calibration of a given sector.

In certain aspects, either the transmit chain of the access point or receive chain of the access point may be calibrated. This may be done, for example, by utilizing a calibration ratio to calibrate the receive chain of the access point to it's transmit chain or calibrate it's transmit chain to it's receive chain. The calibration ratio may then may be utilized to calibrate the transmit chain of the access point or receive chain of the access point.

As used herein, an access point may be a fixed station used for communicating with the terminals and may also be referred to as, and include some or all the functionality of, a base station, a Node B, or some other terminology. An access terminal may also be referred to as, and include some or all the functionality of, a user equipment (UE), a wireless communication device, terminal, a mobile station or some other terminology.

It should be noted that while FIG. 1, depicts physical sectors, i.e. having different antenna groups for different sectors, other approaches may be utilized. For example, utilizing multiple fixed "beams" that each cover different areas of the cell in frequency space may be utilized in lieu of, or in combination with physical sectors. Such an approach is depicted and disclosed in copending U.S. patent application Ser. No. 11/260,895, entitled "Adaptive Sectorization In Cellular System," which is incorporated herein by reference.

Figure 2:
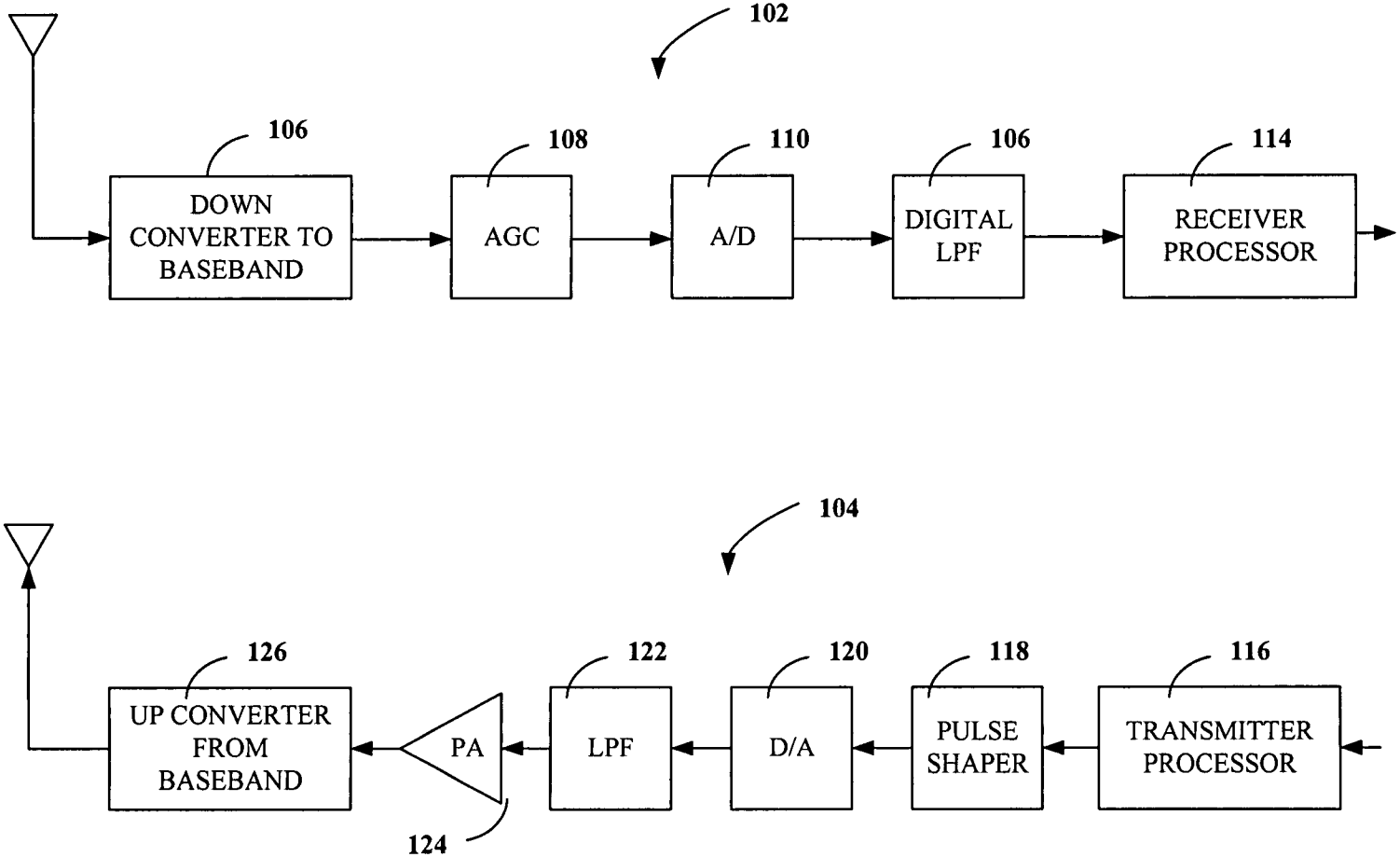
FIG. 2 illustrates an antenna arrangement comprising a receiver chain and a transmitter chain in accordance with various aspects described herein.

Referring to FIG. 2, an antenna arrangement 100 comprising a receiver chain 102 and a transmitter chain 104 in accordance with various aspects described herein is illustrated. Receiver chain 102 comprises a down converter component 106 that down converts a signal to a baseband upon receipt. Down converter component 106 is operatively connected to an automatic gain control (AGC) functionality 108 that assesses received signal strength and automatically adjusts a gain applied to the received signal to maintain receiver chain 102 within its associated linear operation range and to provide a constant signal strength for outputting through transmitter chain 104. It will be appreciated that AGC 108 can be optional to some embodiments described herein (e.g., automatic gain control need not be performed in conjunction with every embodiment). AGC 108 is operatively coupled to an analog-to-digital (A/D) converter 110 that converts the received signal to digital format before the signal is smoothed by a digital low-pass-filter (LPF) 112 that can mitigate short-term oscillations in the received signal. Finally, receiver chain 102 can comprise a receiver processor 114 that processes the received signal and can communicate the signal to one or more components of transmitter chain 104.

Transmitter chain 104 can comprise a transmitter processor 116 that receives a signal from receiver chain 102 (e.g., transmitter receives a signal that was originally received by receiver chain 102 and subjected to various processes associated with the components thereof, . . . ). Transmitter processor 116 is operatively coupled to a pulse shaper 118 that can facilitate manipulating a signal to be transmitted such that the signal can be shaped to be within bandwidth constraints while mitigating and/or eliminating inter-symbol interference. Once shaped, the signal can undergo digital-to-analog (D/A) conversion by a D/A converter 120 before being subjected to an operatively associated low-pass filter (LPF) 122 in transmitter chain 104 for smoothing. A pulse amplifier (PA) component 124 can amplify the pulse/signal before up-conversion to the baseband by an up-converter 126.

Antenna array 100 may exist for each antenna of both an access point and access terminal. As such, there may be a noticeable difference observed between transfer characteristics of transmitter chain 104 and receiver chain 102 and/or samples thereof, reciprocity of the equivalent channel and/or transmitter/receiver variations may not be assumed. When calibrating an array of antennas 100, an understanding of the magnitude of variations, in terms of the effects on the phase and/or amplitude, of signals propagated along the transmitter and receiver chains and their influence on the accuracy of a reciprocity assumption may be utilized in order to facilitate the calibration process. Furthermore, in the case of an antenna array, generally each antenna 100 has a different transmitter chain 104 and a receiver chain 102 than each other antenna. Therefore, each different transmitter chain 104 may have different effects, in terms of phase and/or amplitude, as any other transmitter chain 104, respectively. The same can be true for receiver chains 102 of each antenna 100.

The mismatches in the effects can be due to the physical structure of the antenna 100, component differences, or a number of other factors. Such mismatches can include, for example, mutual coupling effects, tower effects, imperfect knowledge of element locations, amplitude and/or phase mismatches due to antenna cabling, and the like. Additionally, examples include, mismatches can be due to hardware elements in transmitter chain 104 and/or receiver chain 102 of each antenna 100. For example, such mismatches can be associated with analog filters, I and Q imbalance, phase and/or gain mismatch of a low-noise amplifier or an amplifier in the chains, various non-linearity effects, etc.

For an access point, to calibrate each transmit chain to its corresponding receive chain (i.e. the receive chain corresponding to the same antenna) independently would require a complex and potentially unwieldy process. Further, any specific feedback, for forward link transmission, or pilots, used for reverse link transmission, for any given access terminal is subject to the noise for that user. Therefore, for any given calibration ratio estimated based on both the forward and reverse links, there is some error introduced by the channel variation and noise. Therefore, in several aspects, one or more calibration ratios estimated for a number of different access terminals are combined in order to obtain a single calibration ratio to be used by the access point for transmission to one or all of the access terminals. In certain aspects, the combination may constitute an average of all, or some predetermined subset, of the calibration ratios for each access terminal communicating with the access point. In another aspect, the combination may be done in a joint optimization fashion where the channel measurements from and for each access terminal are combined to estimate a single calibration ratio that is a combination of the gain mismatches for each access terminal, without calculating an individual calibration ratio for each access terminal.

For any given access terminal, the access point uses the related reverse link channel estimates and forward link channel estimates, which are performed at the access terminal and fed back to the access point, in order to estimate or calculate the calibration ratio, based on that access terminal.

A forward link channel estimate, $\hat{h}_{AT}^{(i)}$, may be estimated at the access terminal for transmissions from the access point's i-th transmit antenna. However, any channel estimate will have components related to the noise of the channel, along with any gain or distortion caused by the access points transmit chain and the access terminals receive chain. The forward link channel estimate may then be written as:

(Equation 1)

$$\hat{h}_{AT}^{(i)} = \beta_{AT} \cdot \alpha_{AP}^{(i)} \cdot h_i + n_i$$

*AT* receive chain gain mismatch

*AP* transmit chain gain mismatch

Physical channel

Measurement noise

In Equation 1, channel estimate is a function of the gain mismatch $\beta_{AT}$ of the access terminal receiver chain, the gain mismatch $\alpha_{AP}^{(i)}$ of the transmitter chain of the access point, $h_i$ which is the physical channel between the two antennas being measured, and the noise $n_i$ of the channel that is part of the channel estimate.

In the case of reverse link transmissions the channel estimate at the access point's i-th receive antenna due to transmission from the AT $\hat{h}_{AP}^{(i)}$ is essentially an inverse of Equation 1. This can be seen in Equation 2 below:

(Equation 2)

$$\hat{h}_{AP}^{(i)} = \alpha_{AT} \cdot \beta_{AP}^{(i)} \cdot h_i + \upsilon_i$$

*AT* transmit chain

*AP* receive chain gain mismatch

Physical channel

Measurement noise

In Equation 2, this channel estimate is a function of the gain mismatch $\alpha_{AT}$ of the access terminal transmit chain, the gain mismatch $\beta_{AP}^{(i)}$ of the access point receiver chain, $h_i$ which is the physical channel between the two antennas being measured, and the noise $v_i$ of the channel that is part of the channel estimate.

In order to calibrate the antenna array the mismatch errors between receiver chains 102 and transmitter chains 104 of antennas 100 therein is shown below in equation 3. It should be noted that other methodologies and mathematical relationships may be employed to achieve array calibration in conjunction with, in lieu of, the methodologies and mathematical relationships described herein.

(Equation 3)

$$c_i = \frac{\hat{h}_{AP}^{(i)}}{\hat{h}_{AT}^{(i)}} = \frac{\alpha_{AT}}{\beta_{AT}} \cdot \frac{\beta_{AP}^{(i)}}{\alpha_{AP}^{(i)}} = \gamma \cdot \frac{\beta_{AP}^{(i)}}{\alpha_{AP}^{(i)}} = \gamma \cdot \eta_i$$

In Equation 3, $c_i$ is the overall mismatch ratio between reverse link transmissions and forward link transmission, $\gamma$ is the mismatch ratio of the gains between transmit and receive chains of the access terminal, and $\eta_i$ is the mismatch ratio of the receive and transmit chains for the ith antenna at the access point. It should be noted that $\gamma$ is substantially constant for each antenna pair at the access point. Also, in some regards Equation 3 is idealized, as the noise estimate is not included therein.

The calibration ratios $c_i$, i=1, . . . , M, where M is the number of antennas in the access point antenna array can be grouped into one vector $\tilde{c}$, for each access terminal, which may be termed a "calibration vector."

(Equation 4)

$$\tilde{c} = \begin{bmatrix} \tilde{c}_1 \\ \tilde{c}_2 \\ \vdots \\ \tilde{c}_M \end{bmatrix} = \gamma \cdot \begin{bmatrix} \eta_1 \\ \eta_2 \\ \vdots \\ \eta_M \end{bmatrix} + \begin{bmatrix} z_1 \\ z_2 \\ \vdots \\ z_M \end{bmatrix} = \gamma \cdot \eta + n$$

In Equation 4, the entries of vector $\tilde{c}$ correspond to the estimates for each antenna of the access point with respect to a single access terminal. It should be noted that the elements of vector $\hat{c}$ may be complex numbers including both the amplitude and phase mismatch for each transmit and receive chains of the access point antenna array as well as common mismatch corresponding to the transmit and receive mismatch of the access terminal transmit and receive chains.

The noise vector n includes effects of channel measurement errors (MSE) and also the effects of channel measurement de-correlation, since the measurements of the gains are performed at different times thus allowing channel variation over time as well as temperature and other variations, to effect the measurement.

An estimated calibration vector $\tilde{c}_u$ corresponding to access terminal u, may be determined as shown below in Equation 5.

$$\tilde{c}_u = \gamma_u \cdot \eta \quad \text{(Equation 5)}$$

where $\gamma_u$ is the gain mismatch corresponding to the access terminal transmit and receive chains and $\eta$ is the mismatch vector corresponding to the access point antenna array transmit and receive chains. The vector $\tilde{c}_u$ is determine for all of the antennas of the access point antenna array.

In the above it should be noted that there are several methods to combine different calibration estimates (corresponding to measurements from different access terminals) to generate an overall or combined calibration estimates. One way to do this combination is to average all the calibration estimates to obtain a single estimate.

In this approach, each calibration vector estimate includes a multiplicative factor, $\gamma_u$, which is different for different access terminals. In a case where one or more access terminals have a very large gain mismatch $\gamma_u$, simple averaging may lead to results that bias the average toward the access terminals having the largest gain mismatch $\gamma_u$.

In another aspect, each calibration vector estimate, corresponding to a specific access terminal, is normalized according to an element of the vector. This may provide minimization in those cases where one or more access terminals have high gain mismatch $\gamma_u$. This process is depicted below in Equation 6.

$$\bar{c}_u = \frac{\tilde{c}_u}{\tilde{c}_{u,1}}, \quad \text{(Equation 6)}$$

$$\tilde{c} = \frac{1}{U}\sum_{u=1}^{U} \bar{c}_u$$

It should be noted that, in certain aspects, the normalizing element may be any element of the calibration vector, as long as it is the same element for each calibration vector estimate, e.g. the first element or another element. The sum of the normalized elements is then divided by the total number of elements U of the vector $\tilde{c}$.

Another approach that may be utilized to combine different calibration vector estimates may be based upon combining the estimated vectors in a matrix. For instance, in certain aspects, it may be that that each calibration vector estimate is a rotated and scaled version of the same vector $\eta$ and the rotation and scaling are due to the different access terminal mismatches $\gamma_u$. One way to get rid of this scaling and rotation is to first normalize each calibration vector to have a unit norm. Then, a matrix Q whose columns are the normalized calibration vector estimates may be formed from the calibration vectors. A single estimate for the calibration vector is obtained by performing a decomposition of the matrix, e.g. a singular value decomposition on the matrix Q. The eigenvector corresponding to the maximum singular value may be used as the overall calibration vector estimate, e.g. as shown in Equation (7) below.

$$Q = [\,\hat{c}_1 \;\; \hat{c}_2 \;\; \ldots \;\; \hat{c}_U\,],\ \hat{c}_j = \frac{\tilde{c}_j}{\|\tilde{c}_j\|}\ j = 1, \ldots, U \quad \text{(Equation 7)}$$

$$SVD(Q) = U \cdot S \cdot V$$

As exemplified in the three approaches above, a calibration ratio is generally estimated in two steps. First, values corresponding to the elements of calibration vectors are calculated for the antenna array, or those antennas of interest, with respect to the individual access terminals. The calibration vectors are then combined according to one or more different mathematical processes.

An alternative to calculating multiple calibration vectors is to utilize a joint optimization procedure using multiple access point and access terminal measurement as follows. In some cases, the access terminal and access point may generate their channel estimates for different frequency tones and at different time instants. Further, there may be a timing error of $\tau_{k,u}$ between the access point and the u-th access terminal at time k. In such a case, the forward link channel vector estimate $g_{i,k,u}$ measured at the access terminal may be related to the reverse link channel vector estimate $h_{i,k,u}$ measured at the access point. One approach, utilizing the calibration vector $\eta$, and the access terminal mismatch $\gamma_u$ is depicted in Equation 8 below.

$$g_{i,k,u} = \gamma_u \cdot e^{-j\omega_i \tau_u} \cdot diag(h_{i,k,u}) \cdot \eta + n_{i,k,u} \quad \text{(Equation 8)}$$

$$= \gamma_{i,k,u} \cdot Z_{i,k,u} \cdot \eta + n_{i,k,u}$$

In Equation 8, $Z_{i,k,u}$ is a diagonal matrix whose diagonal elements are the elements of the reverse link channel vector estimate $h_{i,k,u}$ and $\gamma_{i,u} = \gamma_u \cdot e^{-j\omega_i \tau_u}$. The subscripts i,k,u, are the tone, time, and user indexes, respectively. In the above equation, the unknowns are the calibration vector $\eta$ and the access terminal specific mismatch $\gamma_{i,k,u}$. A feature of Equation 8 is that access terminal mismatch includes the effect of the timing mismatch between the access point and the access terminal in addition to the gain mismatch due to the access terminal transmit and receive chains. One way to obtain a solution for $\eta$ and $\gamma_{i,k,u}$ is to utilize a minimum mean squared error (MMSE) approach as shown in Equation 9.

$$\rho = \sum_{i,k,u} \|\bar{\gamma}_{i,k,u} \cdot g_{i,k,u} - Z_{i,k,u} \cdot \eta\|^2 \quad \text{(Equation 9)}$$

$$\{\eta, \bar{\gamma}_{i,k,u}\} = \underset{\eta, \bar{\gamma}_{i,k,u}}{\operatorname{argmin}} \rho_u(\eta, \bar{\gamma}_{i,k,u})$$

$$s.t.\ \|\eta\| = 1$$

Solutions for $\eta$ and $\gamma_{j,k,u}$ may be given by Equation 10 below.

$$\eta = \text{minimal eigenvector of } F = \sum_u F_u \quad \text{(Equation 10)}$$

$$= \sum_{i,k,u} Z^*_{i,k,u} \cdot \prod_{g_{i,k,u}}^{\perp} \cdot Z_{i,k,u}$$

$$\gamma_{i,k,u} = \frac{g^*_{i,k,u} \cdot Z_{i,k,u} \cdot \eta}{g^*_{i,k,u} g_{i,k,u}}$$

where, for a vector x, the orthogonal projection operator $\Pi_x^{\perp}$ may be defined as $$\prod_x^{\perp} = I - \frac{xx^*}{x^*x} \quad \text{(Equation 11)}$$

To compensate for the mismatches, the calibration ratios may be used to alter the gain, in terms of both, or either, the phase and amplitude of the transmitter chain of the access point to match it to its receiver chain or equivalently to alter the gain of the receive chain of the access point to match it to its transmit chain.

In certain aspects, the access point may use maximal ratio combining (MRC) beamforming, equal gain combining (EGC) beamforming, or any other spatial pre-processing techniques for transmission to any access terminal. That is, if the reverse link channel vector is h, the access point uses the following pre-processing weights for transmission:

$$w_{MRC}(h) = h^* / |h|, \quad \text{(Equation 12)}$$

$$|h| = \sqrt{h^* \cdot h} \quad \text{for } MRC$$

$$w_{EGC}(h) = \frac{1}{\sqrt{M}} \exp(-j\varphi_h),$$

$$\varphi_h = \square h \quad \text{for } EGC$$

With a calibration vector estimate η, the access point may uses the following pre-processing weights to compensate for its transmit and receive chain mismatches:

$$w_{MRC} = diag(\eta) \cdot h^* / |h|, \quad \text{(Equation 13)}$$

$$|h| = \sqrt{h^* \cdot h} \quad \text{for } MRC$$

$$w_{EGC} = diag(\eta_\phi) \cdot \frac{1}{\sqrt{M}} \exp(-j\varphi_h),$$

$$\varphi_h = \square h \quad \text{for } EGC$$

where $$diag(\eta_\phi) = diag(\square\eta).$$

While FIG. 2, depicts and describes one embodiment of receiver chain 102 and transmitter chain 104 other layouts and structures may be utilized. For example, a different number of components may be used in both receiver chain 102 and transmitter chain 104. Additionally, different devices and structures may also be substituted.

Figure 3:
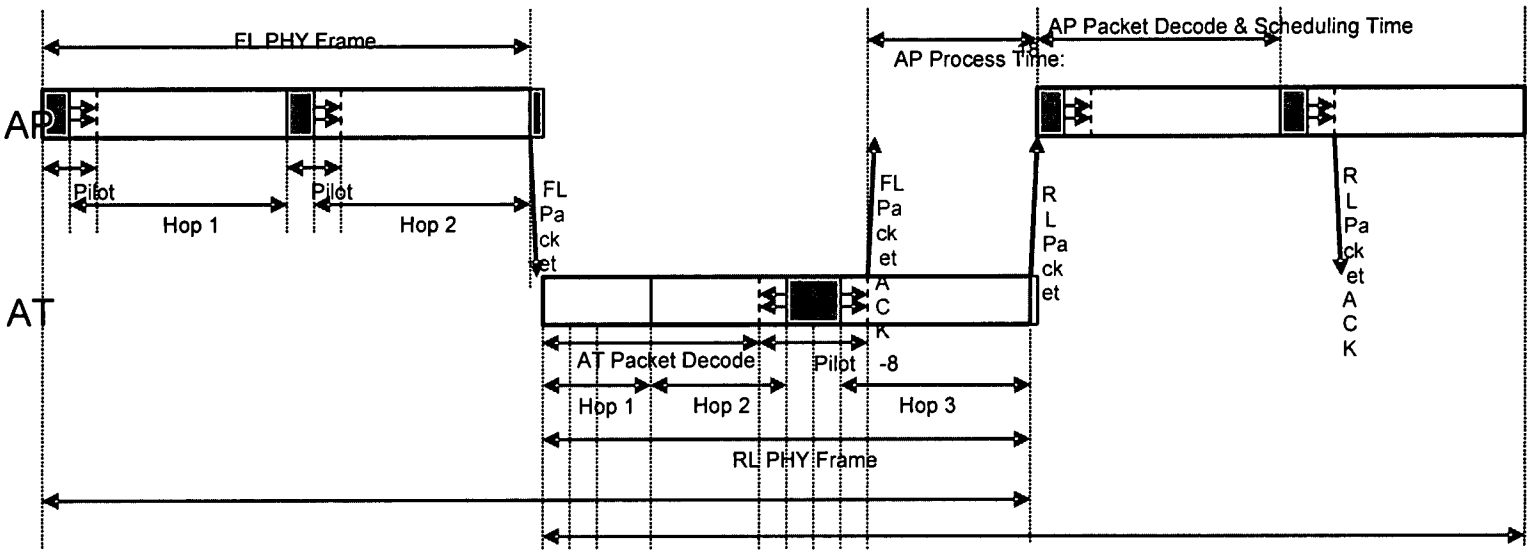
FIG. 3 illustrates aspects timing for calibration operations.

FIG. 3 illustrates a timing cycle for a calibration from a single access terminal, where a TDD system having a single forward link frame or burst adjacent to a single reverse link frame or burst is utilized. As can be seen, one or more pilots transmitted on the reverse link is(are) measured at the access point. The time period of the measurement is a function of the decoding time of the access point. During this decoding period one or more pilots are transmitted on the forward link to the access terminal. The access terminal then measures the pilots to estimate the forward link channel. As with the reverse link estimates, some decoding lag exists. The decoded forward link estimates need to be transmitted back to the access point in order to generate the calibration ratio. Therefore, it can be seen that there is some minimum amount of time, and therefore maximum access terminal velocity, for which calibration can be maintained without drift being a strong or substantially interfering factor.

As can be seen from FIG. 3, if multiple channel estimates from multiple access terminals are utilized the noise and drift associated may be reduced or at least sampled over a range of times and receive chains thus receiving the overall calibration gain.

Figure 4:
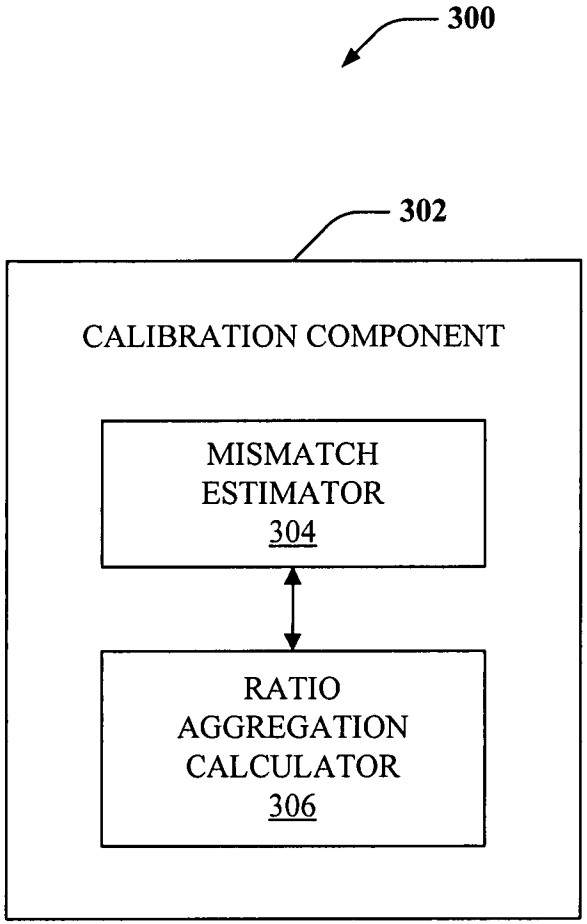
FIG. 4 illustrates aspects of logic that facilitates calibrating an antenna array to compensate for gain mismatch.

FIG. 4 illustrates aspects of logic that facilitates calibrating an antenna array to compensate for gain mismatch. The system 300 comprises a calibration component 302 that includes a mismatch estimation component 304 that analyzes models receiver chain output signals and/or comparisons between receiver chain output signals and a ratio aggregation calculator 306 that calculates ratios that are used to generate vector $\tilde{c}_u$ and aggregates them for use using one of the methods described above to combine different measurements from different access terminals.

Figure 5:
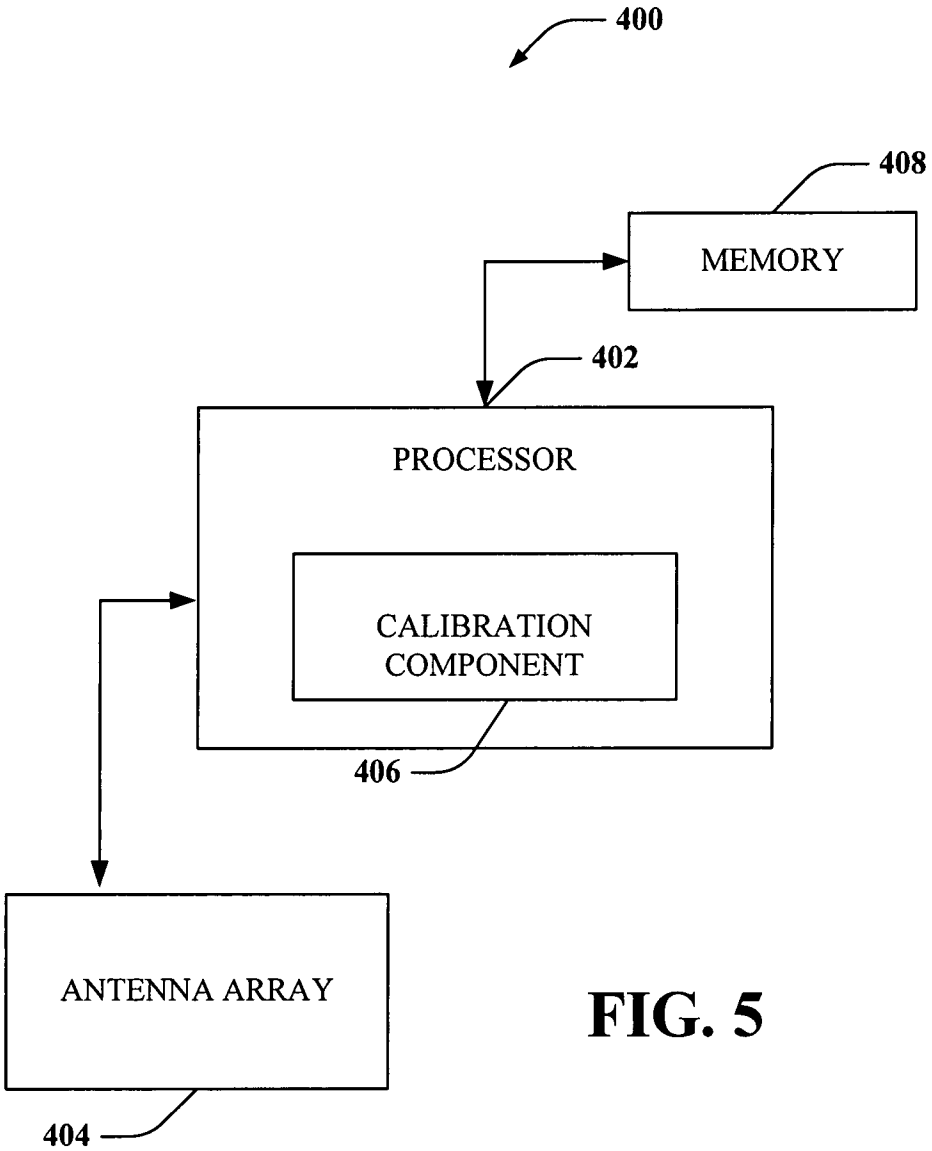
FIG. 5 illustrates aspects of a system that facilitates calibrating an antenna array to compensate for gain mismatch.

FIG. 5 illustrates aspects of a system that facilitates calibrating an antenna array to compensate for gain mismatch. The system 400 comprises a processor 402 that is operatively coupled to an antenna array 404. Processor 402 can determine gain mismatches for individual antenna combinations at the access terminal and access point utilizing calibration component 406. Processor 402 further comprises a calibration component 406 that determines the calibration ratios and then generates and utilizes the vector $\tilde{c}_u$.

System 400 can additionally comprise memory 408 that is operatively coupled to processor 402 and that stores information related to array calibration, ratio generation and utilization, and generating calibration data, etc., and any other suitable information related to calibrating antenna array 404. It is to be appreciated that processor 402 can be a processor dedicated to analyzing and/or generating information received by processor 402, a processor that controls one or more components of system 400, and/or a processor that both analyzes and generates information received by processor 402 and controls one or more components of system 400.

Memory 408 can additionally store protocols associated with generating signal copies and models/representations, mismatch estimations, etc., such that system 400 can employ stored protocols and/or algorithms to achieve antenna calibration and/or mismatch compensation as described herein. It will be appreciated that the data store (e.g., memories) components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), or flash memory. Volatile memory can include random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). The memory 408 of the subject systems and methods is intended to comprise, without being limited to, these and any other suitable types of memory.

In certain aspects, memory 408 can store the calibration vectors $\tilde{c}_u$ for each state, i.e. level of amplification, of the AGC. In such aspects, for each transmission, the processor 402 may access the calibration vector $\tilde{c}_u$ for the AGC state without performing a calibration. The decision as to whether to perform an additional calibration or access a prior calibration vector $\tilde{c}_u$ for a give transmission may be based upon a time period or number of transmissions since the calibration vector $\tilde{c}_u$ for the AGC state was obtained. This may be system parameter or may vary based upon channel conditions, e.g. loading of the channel.

Figure 6:
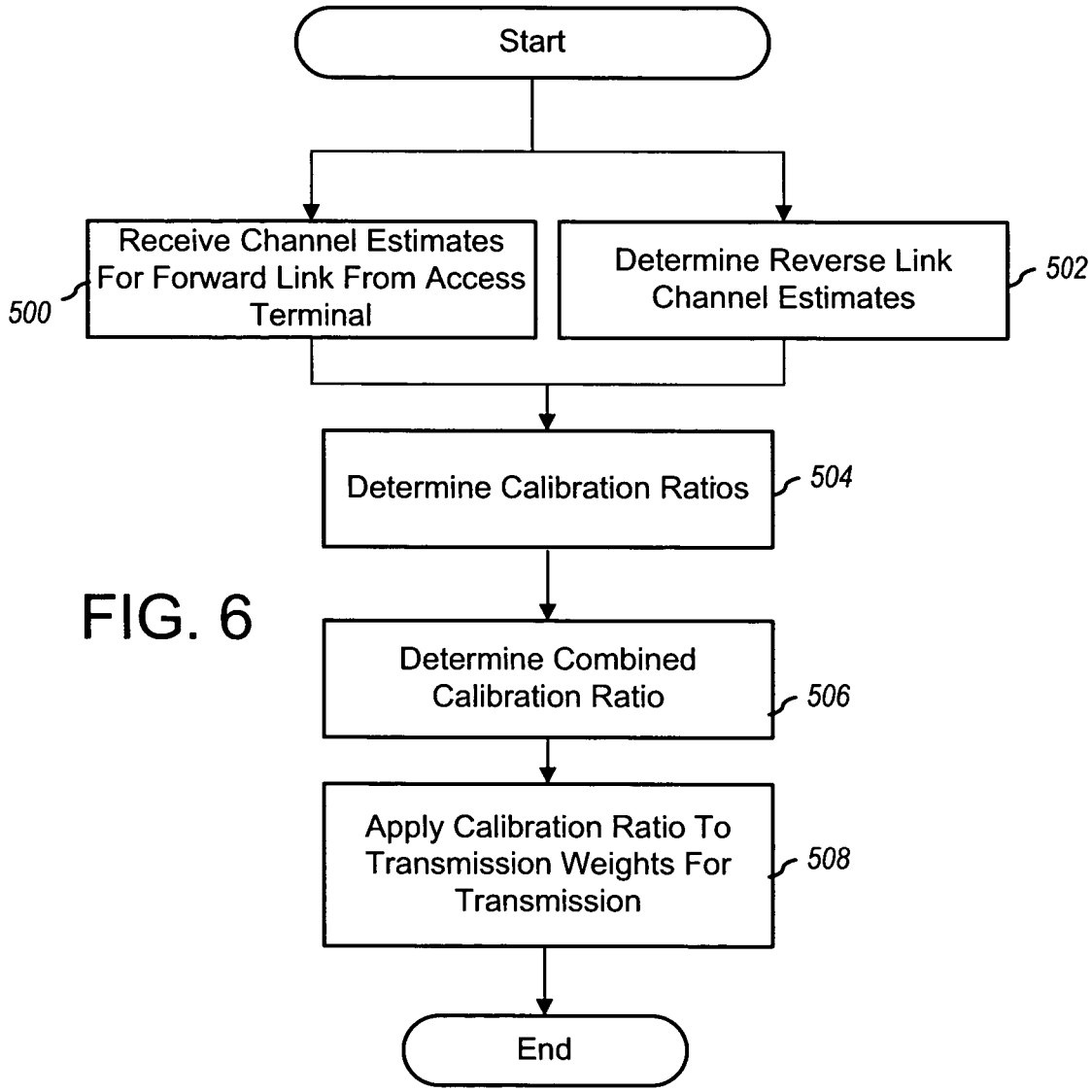
FIG. 6 illustrates aspects of a methodology for calibrating an array of antennas.

FIG. 6 illustrates a methodology for calibrating an array of antennas for transmission. Channel estimates for the forward link are received from access terminals, block 500. As discussed above, these channel estimates may be generated from forward link pilots transmitted by the access point. Additionally, channel estimates for the reverse link information, e.g. reverse link channel pilots, are generated by the access point, block 502.

After both forward link and reverse link channel estimates are collected, calibration ratios for each access terminal and access point antenna may be determined, block 504. In certain aspects, the most recent forward link and reverse link channel estimate with respect to each other in time is utilized to form a calibration ratio. In such cases, multiple estimates for a given access terminal may be performed based upon consecutive channel estimate pairs of forward link and reverse link estimates.

As discussed with respect to FIG. 3, there may be some time lag between the different calculations and transmissions. Further, the functionality for blocks 500 and 502 may occur substantially simultaneously or at different times for the same or different access terminals. Therefore, a calibration ratio may be determined for a given access terminal based upon channel estimates of the forward link and reverse link transmissions that may or may not be consecutive in time.

The calibration ratios are then combined to form a calibration estimate over multiple access terminals, block 506. This combined calibration ratio may include calibration ratios to some or all of the access terminals in a given sector or cell, and have an unequal or equal number of calibration ratios for each access terminal for which one or more calibration ratios are being obtained.

The combined calibration ratio may be obtained by simply averaging the calibration ratios or utilizing the other approaches discussed with respect to FIG. 2, e.g. the approaches discussed with respect to Equations 5 or 7.

Each transmission from each transmission chain of the access point is then weighted with weights based upon the combined calibration ratio for that transmit chain, block 508. Also, a combined or joint set of calibrations weights may be utilized for one or more transmit chains of the access point. Alternatively, it is possible to transmit this combined calibration ratio or a calibration instruction based upon the combined calibration ratio to one or more access terminals. The access terminals would then apply the weights based upon the combined calibration ratio to decoding of the transmissions received at the access terminal.

Also, in some aspects, the calibration weights are utilized for a particular AGC state and not for other AGC states. As such, block 508, would then only apply to the AGC state during block 500.

Figure 7:
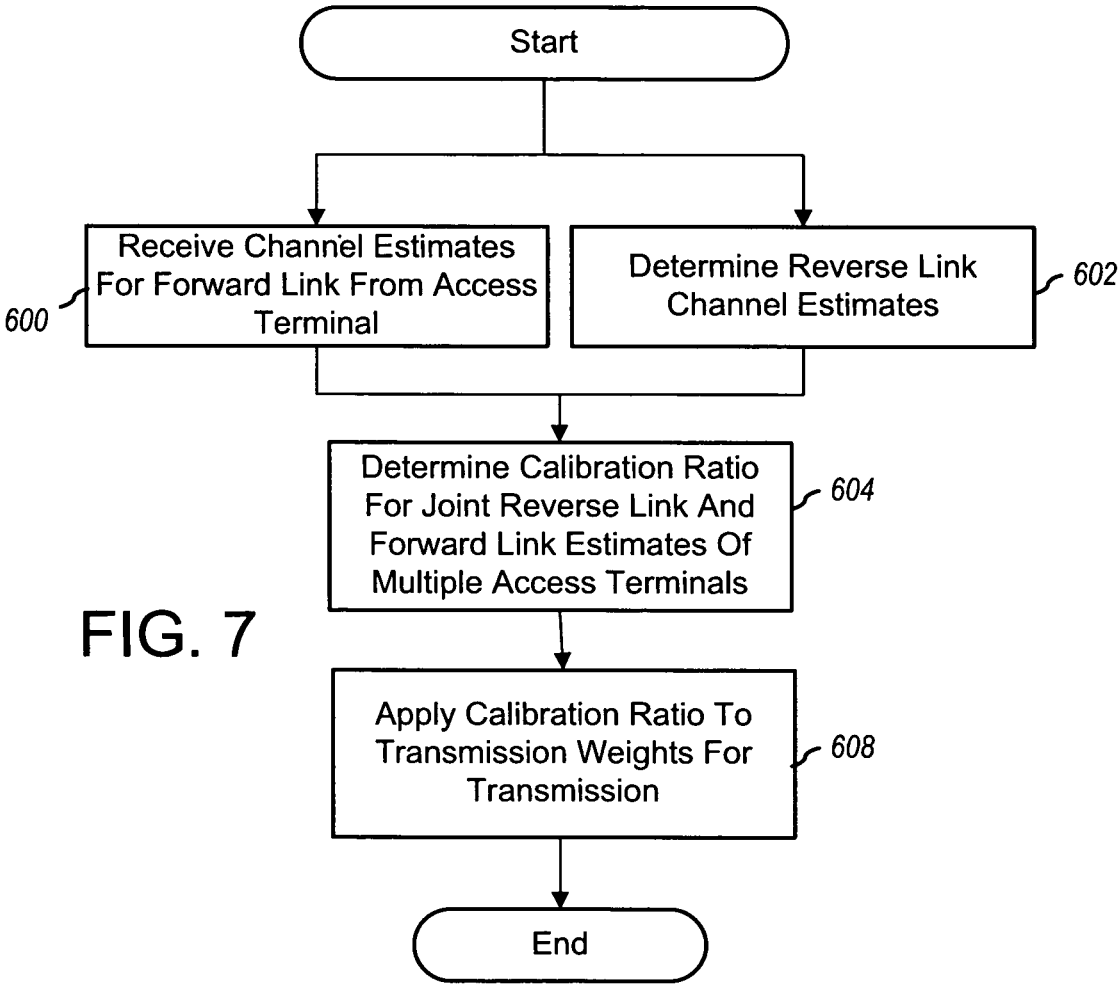
FIG. 7 illustrates aspects of a methodology for calibrating an array of antennas.

FIG. 7 illustrates another methodology for calibrating an array of antennas for transmission. Channel estimates for the forward link are received from access terminals, block 600. As discussed above, these channel estimates may be generated from forward link pilots transmitted by the access point. Additionally, channel estimates for the reverse link information, e.g. reverse link channel pilots, are generated by the access point, block 602.

After both forward link and reverse link channel estimates are collected, a calibration ratio that utilizes multiple channel estimates for multiple access terminals block 604. In certain aspects, the most recent forward link and reverse link channel estimate with respect to each other in time is utilized. In such cases, multiple estimates for a given access terminal may be performed based upon consecutive channel estimate pairs of forward link and reverse link estimates.

As discussed with respect to FIG. 3, there may be some time lag between the different calculations and transmissions. Further, the functionality for blocks 600 and 602 may occur substantially simultaneously or at different times for the same or different access terminals. Therefore, the channel estimates may be determined for a given access terminal based upon channel estimates of the forward link and reverse link transmissions that may or may not be consecutive in time.

The joint calibration ratio may be obtained by utilizing a joint optimization process as discussed with respect to FIG. 2, e.g. to Equation 8.

Each transmission from each transmission chain of the access point is then weighted with weights based upon the joint calibration ratio for that transmit chain, 608. Also, a combined or joint set of calibrations weights may be utilized for one or more transmit chains of the access point. Alternatively, it is possible to transmit this joint calibration ratio or a calibration instruction based upon the joint calibration ratio to one or more access terminals. The access terminals would then apply the weights based upon the joint calibration ratio to decoding of the transmissions received at the access terminal.

Also, in some aspects, the calibration weights are utilized for a particular AGC state and not for other AGC states. As such, block 608, would then only apply to the AGC state during block 600.

Figure 8:
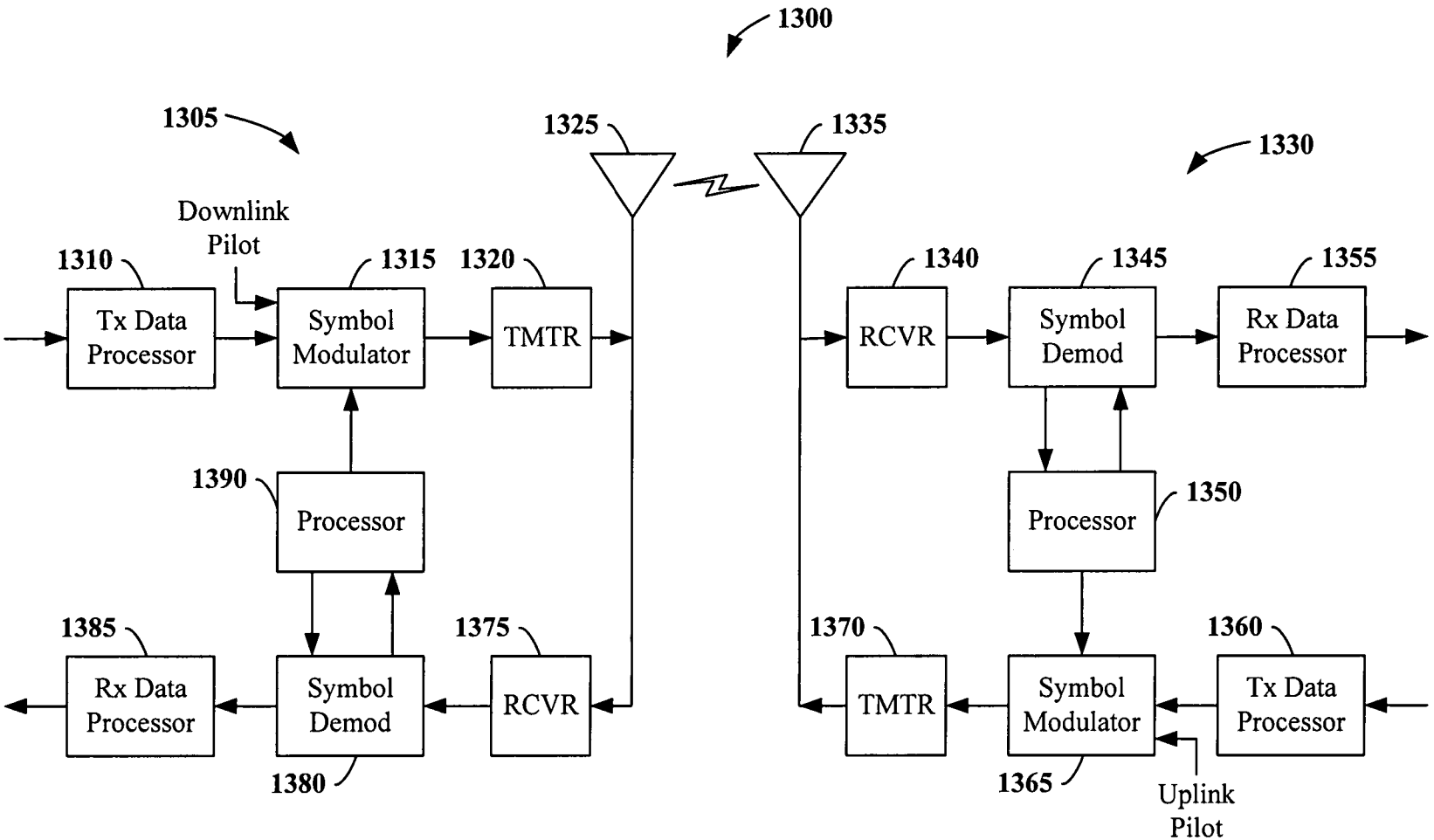
FIG. 8 illustrates aspects of a receiver and transmitter in a wireless communication system.

FIG. 8 illustrates an exemplary wireless communication system 1300. The wireless communication system 1300 depicts one base station and one terminal for sake of brevity. However, it is to be appreciated that the system can include more than one base station and/or more than one terminal, wherein additional base stations and/or terminals can be substantially similar or different for the exemplary base station and terminal described below. In addition, it is to be appreciated that the base station and/or the terminal can employ the systems (FIGS. 1-5) and/or methods (FIGS. 6-7, and 10) described herein to facilitate wireless communication there between.

Referring now to FIG. 8, on a forward link transmission, at access point 1305, a transmit (TX) data processor 1310 receives, formats, codes, interleaves, and modulates (or symbol maps) traffic data and provides modulation symbols ("data symbols"). A symbol modulator 1315 receives and processes the data symbols and pilot symbols and provides a stream of symbols. A symbol modulator 1320 multiplexes data and pilot symbols on the proper subcarriers, provides a signal value of zero for each unused subcarrier, and obtains a set of N transmit symbols for the N subcarriers for each symbol period. Each transmit symbol may be a data symbol, a pilot symbol, or a signal value of zero. The pilot symbols may be sent continuously in each symbol period. It will be appreciated that the pilot symbols may be time division multiplexed (TDM), frequency division multiplexed (FDM), orthogonal frequency division multiplexed (OFDM), code division multiplexed (CDM), etc. Symbol modulator 1320 can transform each set of N transmit symbols to the time domain using an N-point IFFT to obtain a "transformed" symbol that contains N time-domain chips. Symbol modulator 1320 typically repeats a portion of each transformed symbol to obtain a corresponding symbol. The repeated portion is known as a cyclic prefix and is used to combat delay spread in the wireless channel.

A transmitter unit (TMTR) 1320 receives and converts the stream of symbols into one or more analog signals and further conditions (e.g., amplifies, filters, and frequency upconverts) the analog signals to generate a forward link signal suitable for transmission over the wireless channel. The forward link signal is then transmitted through an antenna 1325 to the terminals. At terminal 1330, an antenna 1335 receives the forward link signal and provides a received signal to a receiver unit (RCVR) 1340. Receiver unit 1340 conditions (e.g., filters, amplifies, and frequency downconverts) the received signal and digitizes the conditioned signal to obtain samples. A symbol demodulator 1345 removes the cyclic prefix appended to each symbol, transforms each received transformed symbol to the frequency domain using an N-point FFT, obtains N received symbols for the N subcarriers for each symbol period, and provides received pilot symbols to a processor 1350 for channel estimation. Symbol demodulator 1345 further receives a frequency response estimate for the forward link from processor 1350, performs data demodulation on the received data symbols to obtain data symbol estimates (which are estimates of the transmitted data symbols), and provides the data symbol estimates to an RX data processor 1355, which demodulates (e.g., symbol demaps), deinterleaves, and decodes the data symbol estimates to recover the transmitted traffic data. The processing by symbol demodulator 1345 and RX data processor 1355 is complementary to the processing by symbol modulator 1315 and TX data processor 1310, respectively, at access point 1300.

On the reverse link, a TX data processor 1360 processes traffic data and provides data symbols. A symbol modulator 1365 receives and multiplexes the data symbols with pilot symbols, performs modulation, and provides a stream of symbols. The pilot symbols may be transmitted on subcarriers that have been assigned to terminal 1330 for pilot transmission, where the number of pilot subcarriers for the reverse link may be the same or different from the number of pilot subcarriers for the forward link. A transmitter unit 1370 then receives and processes the stream of symbols to generate a reverse link signal, which is transmitted by the antenna 1335 to the access point 1310.

At access point 1310, the reverse link signal from terminal 1330 is received by the antenna 1325 and processed by a receiver unit 1375 to obtain samples. A symbol demodulator 1380 then processes the samples and provides received pilot symbols and data symbol estimates for the reverse link. An RX data processor 1385 processes the data symbol estimates to recover the traffic data transmitted by terminal 1335. A processor 1390 performs channel estimation for each active terminal transmitting on the reverse link.

The processor 1390 may also be configured to perform generation of the calibration ratios and combined calibration ratio, or the joint calibration ratio as discussed with respect to FIGS. 2, 6 and 7 respectively.

Processors 1390 and 1350 direct (e.g., control, coordinate, manage, etc.) operation at access point 1310 and terminal 1335, respectively. Respective processors 1390 and 1350 can be associated with memory units (not shown) that store program codes and data. Processors 1390 and 1350 can also perform computations to derive frequency and impulse response estimates for the reverse link and forward link, respectively.

Figure 9:
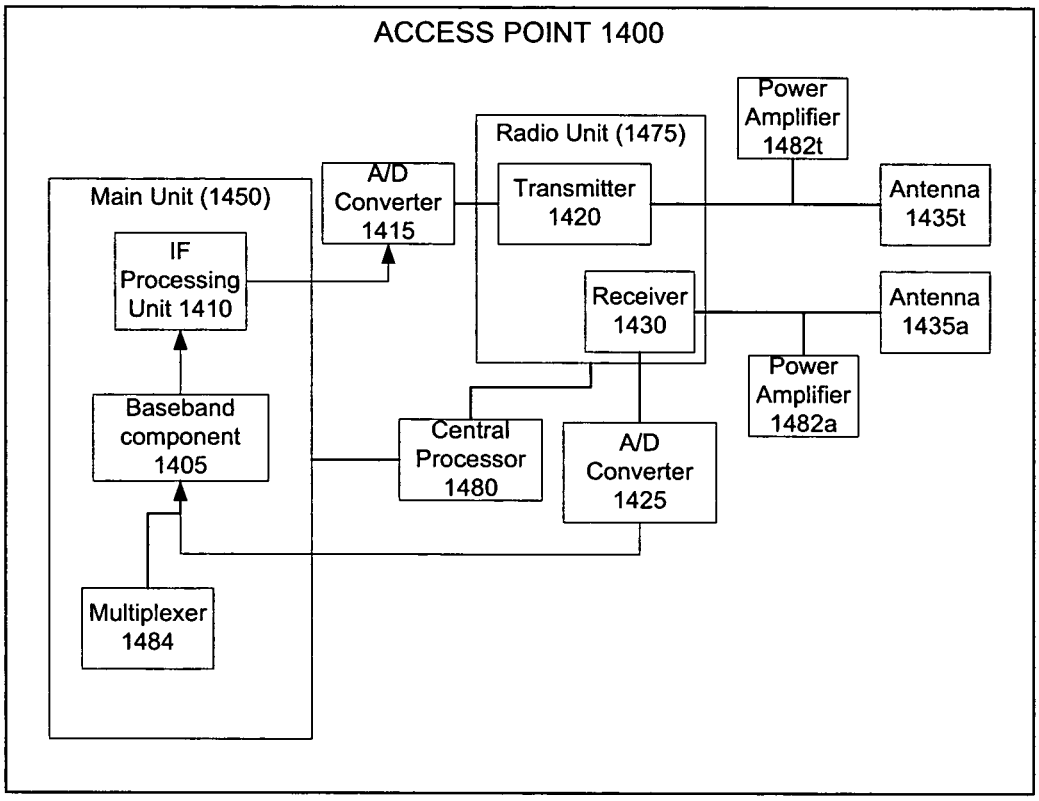
FIG. 9 illustrates aspects of an access point.

Referring to FIG. 9, an access point can comprise a main unit (MU) 1450 and a radio unit (RU) 1475. MU 1450 includes the digital baseband components of an access point. For example, MU 1450 can include a baseband component 1405 and a digital intermediate frequency (IF) processing unit 1410. Digital IF processing unit 1410 digitally processes radio channel data at an intermediate frequency by performing such functions as filtering, channelizing, modulation, and so forth. RU 1475 includes the analog radio parts of the access point. As used herein, a radio unit is the analog radio parts of an access point or other type of transceiver station with direct or indirect connection to a mobile switching center or corresponding device. A radio unit typically serves a particular sector in a communication system. For example, RU 1475 can include one or more receivers 1430 connected to one more antennas 1435*a-t* for receiving radio communications from mobile subscriber units. In an aspect, one or more power amplifiers 1482*a-t* are coupled to one or more antennas 1435*a-t*. Connected to receiver 1430 is an analog-to-digital (A/D) converter 1425. A/D converter 1425 converts the analog radio communications received by receiver 1430 into digital input for transmission to baseband component 1405 via digital IF processing unit 1410. RU 1475 can also include one or more transmitters 120 connected to either the same or different antenna 1435 for transmitting radio communications to access terminals. Connected to transmitter 1420 is a digital-to-analog (D/A) converter 1415. D/A converter 1415 converts the digital communications received from baseband component 1405 via digital IF processing unit 1410 into analog output for transmission to the mobile subscriber units. In some aspects, a multiplexer 1484 for multiplexing of multiple-channel signals and multiplexing of a variety of signals including a voice signal and a data signal. A central processor 1480 is coupled to main unit 1450 and Radio Unit for controlling various processing which includes the processing of voice or data signal.

For a multiple-access system (e.g., a frequency division multiple-access (FDMA) system, an orthogonal frequency division multiple-access (OFDMA) system, a code division multiple-access (CDMA) system, a time division multiple-access (TDMA) system, etc.), multiple terminals may transmit concurrently on the reverse link. For such a system, the pilot subcarriers may be shared among different terminals. The channel estimation techniques may be used in cases where the pilot subcarriers for each terminal span the entire operating band (possibly except for the band edges). Such a pilot subcarrier structure would be desirable to obtain frequency diversity for each terminal. The techniques described herein may be implemented by various means. For example, these techniques may be implemented in hardware, software, or a combination thereof. For a hardware implementation, the processing units used for channel estimation may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof. With software, implementation can be through modules (e.g., procedures, functions, and so on) that perform the functions described herein. The software codes may be stored in memory unit and executed by the processors 1390 and 1350.

Figure 10:
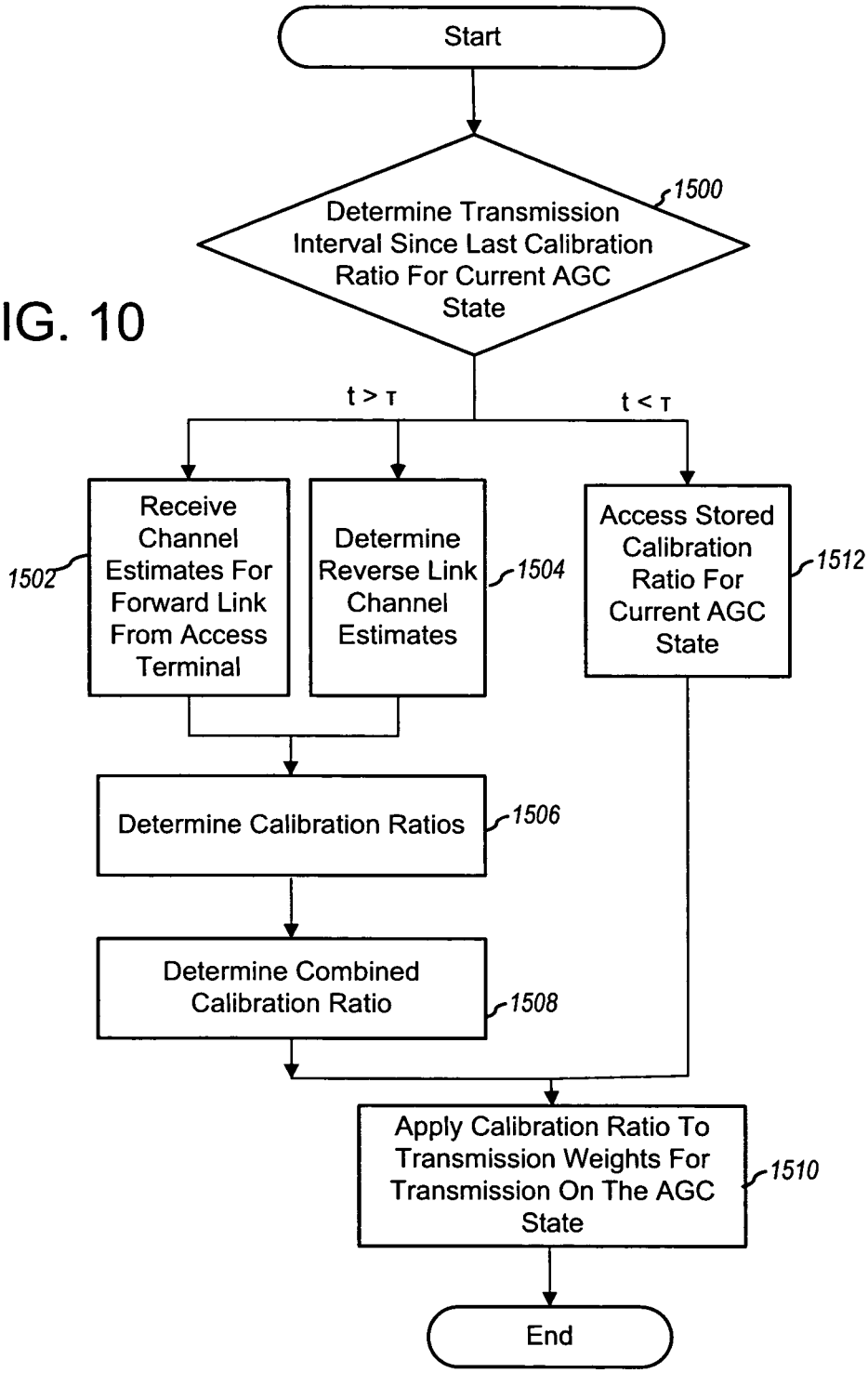
FIG. 10 illustrates aspects of a methodology for calibrating an array of antennas.

FIG. 10 illustrates an additional methodology for calibrating an array of antennas for transmission. A determination is made as to the transmission interval since the last calibration for the current AGC state that is to be utilized for transmission, block 1500. In certain cases this interval may be a function of time elapsed, in others it may be a function of the number of transmission, forward link, reverse link, or both, since the last calibration for the AGC state. This determination is based upon a threshold $\tau$ that may be predetermined or vary based upon conditions, e.g. loading.

If the transmission interval is greater than $\tau$, then another calibration operation is performed, where channel estimates for the forward link are received from access terminals, block 1502 and channel estimates for the reverse link are generated by the access point, block 1504. After both forward link and reverse link channel estimates are collected, a calibration ratio that utilizes multiple channel estimates for multiple access terminals, block 1506.

After both forward link and reverse link channel estimates are collected, a calibration ratio that utilizes multiple channel estimates for multiple access terminals block, 1512. Each transmission, for the AGC state, from each transmission chain of the access point is then weighted with weights based upon the joint calibration ratio for that transmit chain are utilized for the AGC state, 1510.

If the transmission interval is greater than $\tau$, then a calibration vector, e.g. weights, for the particular AGC state are accessed from memory, block 1512. Each transmission, for the AGC state, from each transmission chain of the access point is then weighted with weights based upon memory accessed weights for the AGC state, 1510.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of calibrating an antenna array in a wireless network, comprising:

receiving first channel estimate information corresponding to transmissions to a first access terminal;

determining second channel estimate information corresponding to transmissions from the first access terminal;

receiving third channel estimate information corresponding to transmissions to a second access terminal;

determining fourth channel estimate information corresponding to transmissions from the second access terminal; and determining a calibration ratio based upon the first, second, third, and fourth channel estimate information for at least the first and second access terminals, wherein determining the calibration ratio comprises:

determining a first calibration ratio based upon the first and second channel estimate information;

determining second calibration ratio based upon the third and fourth channel estimate information; and determining the calibration ratio based upon combining the first and second calibration ratios.

2. The method of claim 1, wherein combining comprises averaging the first and second calibration ratios.

3. The method of claim 1, wherein the first and second calibration ratios comprise a plurality of elements each corresponding to at least one antenna of an access point in communication with the first and second access terminals, and wherein combining comprises:

normalizing the first calibration ratio;

normalizing the second calibration ratio; and determining the calibration ratio based upon a matrix including the first and second calibration ratio.

4. The method of claim 3, wherein determining the calibration ratio based upon the matrix comprises decomposing the matrix utilizing singular value decomposition.

5. A method of calibrating an antenna array in a wireless network, comprising:

receiving first channel estimate information corresponding to transmissions to a first access terminal;

determining second channel estimate information corresponding to transmissions from the first access terminal;

receiving third channel estimate information corresponding to transmissions to a second access terminal;

determining fourth channel estimate information corresponding to transmissions from the second access terminal; and determining a calibration ratio based upon the first, second, third, and fourth channel estimate information for at least the first and second access terminals wherein determining the calibration ratio comprises solving the equation:

$$g_{i,k,u} = \gamma_u \cdot e^{-j\omega_i \tau_u} \cdot diag(h_{i,k,u}) \cdot \eta + n_{i,k,u}$$
$$= \gamma_{i,k,u} \cdot Z_{i,k,u} \cdot \eta + n_{i,k,u}$$

where $Z_{i,k,u}$ is a diagonal matrix whose diagonal elements are the elements of the reverse link channel vector estimate $h_{i,k,u}$, $\gamma_{i,u}=\gamma_u \cdot e^{-j\omega_i \tau_u}$, and the subscripts i,k,u, are the tone, time, and user indexes, respectively.

6. The method of claim 5, wherein solving comprising using an MMSE technique to solve the equation.

7. A method of calibrating an antenna array in a wireless network, comprising:

receiving first channel estimate information corresponding to transmissions to a first access terminal;

determining second channel estimate information corresponding to transmissions from the first access terminal;

receiving third channel estimate information corresponding to transmissions to a second access terminal;

determining fourth channel estimate information corresponding to transmissions from the second access terminal; and determining a calibration ratio based upon the first, second, third, and fourth channel estimate information for at least the first and second access terminals;

receiving fifth channel estimate information corresponding to transmissions to a third access terminal;

determining sixth channel estimate information corresponding to transmissions from the third access terminal; and determining calibration ratio based upon the first, second, third, fourth, fifth, and sixth channel estimate information for at least the first, second, and third access terminals.

8. A wireless communication apparatus comprising:

at least two antennas; and a processor coupled with the at least two antennas, the processor configured to determine a calibration ratio for communication with each of the plurality of access terminals, the processor operative to receive first channel estimate information corresponding to transmissions to a first access terminal;

determine second channel estimate information corresponding to transmissions from the first access terminal;

receive third channel estimate information corresponding to transmissions to a second access terminal;

determine fourth channel estimate information corresponding to transmissions from the second access terminal; and determine a calibration ratio based upon the first, second, third, and fourth channel estimate information for at least the first and second access terminals, wherein determining the calibration ratio comprises:

determine a first calibration ratio based upon the first and second channel estimate information;

determine second calibration ratio based upon the third and fourth channel estimate information; and determine the calibration ratio based upon combining the first and second calibration ratios.

9. The wireless communication apparatus of claim 8, wherein the processor is configured to combine the ratios by averaging the first and second the calibration ratios.

10. The wireless communication apparatus of claim 8, wherein the first and second calibration ratios comprise a plurality of elements each corresponding to at least one of said antennas, and wherein the processor is configured to combine the ratios by normalizing the first calibration ratio, normalizing the second calibration ratio, and to determine the calibration ratio based upon a matrix including the first and second calibration ratios.

11. The wireless communication apparatus of claim 10, wherein the processor is configured utilize singular value decomposition to decompose the matrix to obtain the calibration ratio.

12. An wireless communication apparatus comprising:

at least two antennas; and a processor coupled with the at least two antennas, the processor configured to determine a calibration ratio, based upon a plurality of forward link channel estimates and reverse link channel estimates from a plurality of access terminals, for communication with each of the plurality of access terminals, wherein the processor is configured to determine the calibration ratio by solving the equation:

$$g_{i,k,u} = \gamma_u \cdot e^{-j\omega_i \tau_u} \cdot diag(h_{i,k,u}) \cdot \eta + n_{i,k,u}$$
$$= \gamma_{i,k,u} \cdot Z_{i,k,u} \cdot \eta + n_{i,k,u}$$

where $Z_{i,k,u}$ is a diagonal matrix whose diagonal elements are the elements of the reverse link channel vector estimate $h_{i,k,u}$, $\gamma_{i,u}=\gamma_u \cdot e^{-j\omega_i \tau_u}$, and the subscripts i,k,u, are the tone, time, and user indexes, respectively.

13. The wireless communication apparatus of claim 12, wherein the processor is configured to solve the equation by using an MMSE technique.

14. An apparatus comprising:

means for receiving first channel estimate information corresponding to transmissions to a first access terminal;

means for determining second channel estimate information corresponding to transmissions from the first access terminal;

means for receiving third channel estimate information corresponding to transmissions to a second access terminal;

means for determining fourth channel estimate information corresponding to transmissions from the second access terminal;

means for determining a calibration ratio based upon the first, second, third, and fourth channel estimate information for at the least first and second access terminals, means for determining a first calibration ratio based upon the first and second channel estimate information;

means for determining second calibration ratio based upon the third and fourth channel estimate information; and means for determining the calibration ratio based upon combining the first and second calibration ratios.

15. The apparatus of claim 14, wherein the means for combining comprises means for averaging the different calibration ratios.

16. The apparatus of claim 14, wherein the first and second calibration ratios comprise a plurality of elements each corresponding to at least one antenna of an access point in communication with the first and second access terminals, and wherein means for determining comprises:

means for normalizing the first calibration ratios;

means normalizing the second calibration ratio; and means for determining the calibration ratio based upon a matrix including the first and second calibration ratio.

17. A processor-readable medium having stored thereon instructions for use by a processor, the instructions comprise instructions to:

receive first channel estimate information corresponding to transmissions to a first access terminal;

determine second channel estimate information corresponding to transmissions from the first access terminal;

receive third channel estimate information corresponding to transmissions to a second access terminal;

determine fourth channel estimate information corresponding to transmissions from the second access terminal;

determine a calibration ratio based upon the first, second, third, and fourth channel estimate information, for at the least first and second access terminals, determine a first calibration ratio based upon the first and second channel estimate information;

determine second calibration ratio based upon the third and fourth channel estimate information; and determine the calibration ratio based upon combining the first and second calibration ratios.

18. The processor-readable medium of claim 17, further comprising instructions to:

average the first and second calibration ratios.

19. The processor-readable medium of claim 17, wherein the first and second calibration ratios comprise a plurality of elements each corresponding to at least one antenna of an access point in communication with the first and second access terminals, and wherein the instructions to combine the calibration ratios comprises instructions to:

normalize the first calibration ratio;

normalize the second calibration ratio; and determine the calibration ratio based upon a matrix including the first and second calibration ratio.

20. The processor-readable medium of claim 19, wherein the instructions to determine the calibration ratio based upon the matrix comprises instructions to decompose the matrix utilizing singular value decomposition.

21. A wireless communication apparatus comprising:

at least two antennas; and a processor coupled with the at least two antennas, the processor configured to determine a calibration ratio for communication with each of the plurality of access terminals, the processor operative to receive first channel estimate information corresponding to transmissions to a first access terminal;

determine second channel estimate information corresponding to transmissions from the first access terminal;

receive third channel estimate information corresponding to transmissions to a second access terminal;

determine fourth channel estimate information corresponding to transmissions from the second access terminal; and determine a calibration ratio based upon the first, second, third, and fourth channel estimate information for at least the first and second access terminals, receive fifth channel estimate information corresponding to transmissions to a third access terminal;

determine sixth channel estimate information corresponding to transmissions from the third access terminal; and determine a calibration ratio based upon the first, second, third, fourth, fifth, and sixth channel estimate information for at least the first, second, and third access terminals.

22. An apparatus comprising:

means for receiving first channel estimate information corresponding to transmissions to a first access terminal;

means for determining second channel estimate information corresponding to transmissions from the first access terminal;

means for receiving third channel estimate information corresponding to transmissions to a second access terminal;

means for determining fourth channel estimate information corresponding to transmissions from the second access terminal; and means for determining a calibration ratio based upon the first, second, third, and fourth channel estimate information for at least the first and second access terminals, wherein determining the calibration ratio comprises means for solving the equation:

$$g_{i,k,u} = \gamma_u \cdot e^{-j\omega_i \tau_u} \cdot diag(h_{i,k,u}) \cdot \eta + n_{i,k,u}$$
$$= \gamma_{i,k,u} \cdot Z_{i,k,u} \cdot \eta + n_{i,k,u}$$

where $Z_{i,k,u}$ is a diagonal matrix whose diagonal elements are the elements of the reverse link channel vector estimate $h_{i,k,u}$, $\gamma_{i,u}=\gamma_u \cdot e^{-j\omega_i \tau_u}$, and the subscripts i,k,u, are the tone, time, and user indexes, respectively.

23. The apparatus of claim 22, wherein said means for solving comprise means for using an MMSE technique to solve the equation.

24. An apparatus comprising:

means for receiving first channel estimate information corresponding to transmissions to a first access terminal;

means for determining second channel estimate information corresponding to transmissions from the first access terminal;

means for receiving third channel estimate information corresponding to transmissions to a second access terminal;

means for determining fourth channel estimate information corresponding to transmissions from the second access terminal; and means for determining a calibration ratio based upon the first, second, third, and fourth channel estimate information for at least the first and second access terminals;

means for receiving fifth channel estimate information corresponding to transmissions to a third access terminal;

means for determining sixth channel estimate information corresponding to transmissions from the third access terminal; and means for determining a calibration ratio based upon the first, second, third, fourth, fifth, and sixth channel estimate information for at least the first, second, and third access terminals.

25. A processor-readable medium having stored thereon instructions for use by a processor, the instructions comprise instructions to:

receive first channel estimate information corresponding to transmissions to a first access terminal;

determine second channel estimate information corresponding to transmissions from the first access terminal;

receive third channel estimate information corresponding to transmissions to a second access terminal;

determine fourth channel estimate in formation corresponding to transmissions from the second access terminal; and determine a calibration ratio based upon the first, second, third, and fourth channel estimate information for at least the first and second access terminals, wherein determining the calibration ratio comprises solving the equation:

$$g_{i,k,u} = \gamma_u \cdot e^{-j\omega_i \tau_u} \cdot diag(h_{i,k,u}) \cdot \eta + n_{i,k,u}$$
$$= \gamma_{i,k,u} \cdot Z_{i,k,u} \cdot \eta + n_{i,k,u}$$

where $Z_{i,k,u}$ is a diagonal matrix whose diagonal elements are the elements of the reverse link channel vector estimate $h_{i,k,u}$, $\gamma_{i,u}=\gamma_u \cdot e^{-j\omega_i \tau_u}$, and the subscripts i,k,u, are the tone, time, and user indexes, respectively.

26. The processor-readable medium of claim 25, wherein the instructions for solving comprise instructions to use an MMSE technique to solve the equation.

27. A processor-readable medium having stored thereon instructions for use by a processor, the instructions comprise instructions to:

receive first channel estimate information corresponding to transmissions to a first access terminal;

determine second channel estimate information corresponding to transmissions from the first access terminal;

receive third channel estimate information corresponding to transmissions to a second access terminal;

determine fourth channel estimate information corresponding to transmissions from the second access terminal; and determine a calibration ratio based upon the first, second, third, and fourth channel estimate information for at least the first and second access terminals;

receive fifth channel estimate information corresponding to transmissions to a third access terminal;

determine sixth channel estimate information corresponding to transmissions from the third access terminal; and determine a calibration ratio based upon the first, second, third, fourth, fifth, and sixth channel estimate information for at least the first, second, and third access terminals.

* * * * *